United States Patent [19]

Robertson

[11] Patent Number: 4,842,263

[45] Date of Patent: Jun. 27, 1989

[54] SHEET REVERSING APPARATUS

[75] Inventor: William B. Robertson, Buckinghamshire, England

[73] Assignee: Xerox Corporation, Stamford, Conn.

[21] Appl. No.: 616,335

[22] Filed: Jun. 1, 1984

[30] Foreign Application Priority Data

Jun. 8, 1983 [GB] United Kingdom ..... 8315734

[51] Int. Cl.[4] ..... B65H 29/58

[52] U.S. Cl. ..... 271/186; 271/65; 271/272; 271/902

[58] Field of Search ..... 271/184, 185, 186, 225, 271/901, 65, 902, 177, 180, 272, 273, 274, 314

[56] References Cited

U.S. PATENT DOCUMENTS

| | | | |
|---|---|---|---|
| 3,363,816 | 1/1968 | Maddock | 271/314 X |
| 3,856,295 | 12/1974 | Looney | 271/65 |
| 3,944,212 | 3/1976 | Stange et al. | 271/9 |
| 4,054,285 | 10/1977 | Stange et al. | 271/186 |
| 4,214,740 | 7/1980 | Acquaviva | 271/3 |
| 4,262,895 | 4/1981 | Wenthe | 271/184 X |
| 4,275,877 | 6/1981 | Silverberg | 271/166 |
| 4,493,483 | 1/1985 | Teumer et al. | 271/186 |

OTHER PUBLICATIONS

Fertig, F. L., "Stacker for Documents of Varying Size," *IBM Technical Disclosure Bulletin,* vol. 4, No. 5, Oct. 1981, p. 2.

Bullock, M. K., "Sheet Reverser", *IBM Technical Disclosure Bulletin,* vol. 20, No. 1, Jun. 1977, p. 22.

*Primary Examiner*—Andres Kashnikow
*Assistant Examiner*—Matthew C. Graham
*Attorney, Agent, or Firm*—William A. Henry

[57] ABSTRACT

A sheet reversing apparatus is disclosed which includes a buckle chamber and input and output rollers which cooperate with a common roller respectively to form input and output nips for conveying a sheet into and out of the buckle chamber to reverse the lead and trail edge orientation thereof. The trail edge of the sheet is engaged by foam rolls coaxial with the common roller to transfer it from said input nip to said output nip and one or more fingers are arranged to urge the sheet trail edge into contact with the foam rolls.

6 Claims, 3 Drawing Sheets

SHEET REVERSING APPARATUS

Figure 1:
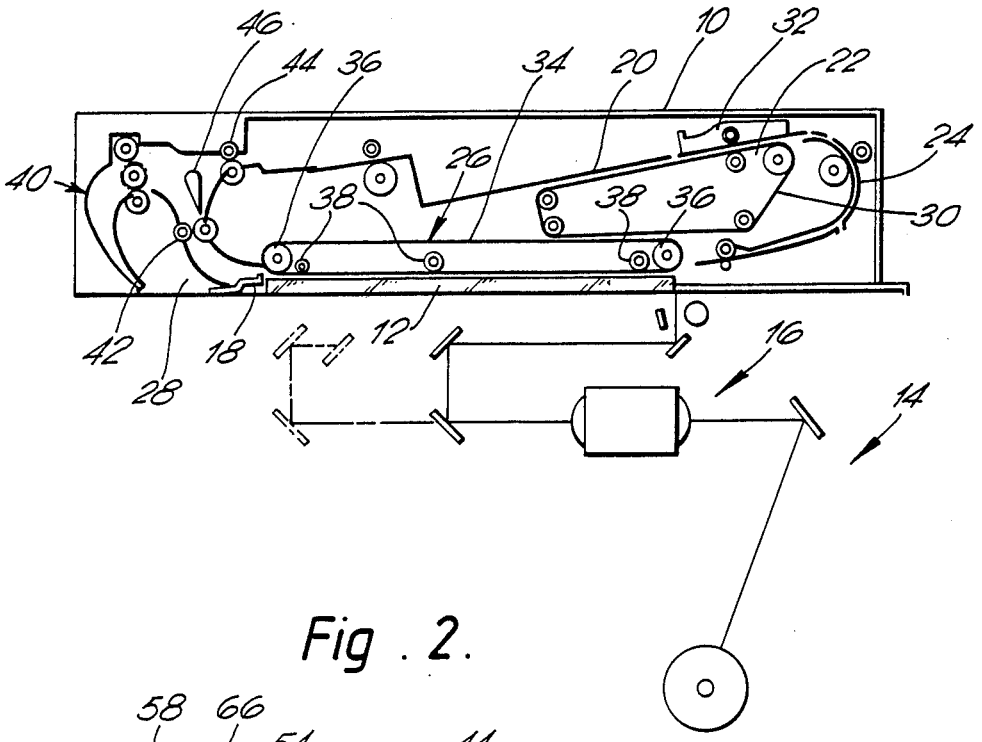

The invention relates to sheet reversing apparatus, particularly for use in inverting sheets, for example in duplex copying and collating such as in electrostatographic copying machines. By diverting a sheet from its normal path of travel into a reversing station and withdrawing the sheet from the reversing station so that the train edge becomes the leading edge, the sheet is inverted and can then be returned to the normal path of travel.

Prior art sheet reversing apparatus often use a roller system for driving sheets to and from the reversing station. U.S. Pat. Nos. 3,944,212, 4,054,285 and 4,214,740 employ a roller system having a center roll engaged by input and output rolls respectively to form input and output nips for conveying a sheet into and out of the reversing station to reverse the lead and trail edge orientation. Usually the reversing station comprises a chamber known as a buckle chamber, which has an end stop so arranged as to limit movement of the sheet as it enters the chamber and cause it to buckle. This ensures that the trail edge of the sheet can engage transfer means by which the trail edge is transferred from the input nip to the output nip whereupon it is engaged by the output nip and driven out of the reversing station. The buckle chamber allows for different magnitudes of paper buckle to take place and hence different lengths of paper can be accommodated. The transfer means generally comprises one or more foam rollers mounted co-axially with the common roll. Such inverters are generally known as tri-roll inverters.

Should the paper be of low beam strength and be curled or have suffered operator folding or damage it has been found that the paper can buckle prematurely in the buckle chamber so that the trail edge of the sheet will be at the wrong approach angle to be influenced by the transfer means (foam rolls). Another cause of this condition may be excessive static or surface friction on the paper surface which resists paper movement to the end stop in the buckle chamber and hence premature buckling can also occur for this reason.

Sheet reversing apparatus according to the present invention is characterised by one or more fingers arranged to urge the sheet trail edge into contact with the transfer means.

In a preferred embodiment in which the transfer means comprises one or more foam rolls mounted co-axially with the common roller for rotation therewith, the or each finger is resiliently mounted so that it can adopt a position extending downstream of the input nip along a tangential line to the at least one foam roll and which intercepts the common tangent to the input and common rollers through the input nip, from a position inward of the outer circumference of the input roll to a position beyond the tangential point on the foam roll. Suitably, the angle of the finger to the common tangent in this position is 5° to 35°, preferably 30°.

Suitably there are two spaced foam rollers and a pair of spaced fingers between or flanking the foam rolls, the fingers being sufficiently resilient to be displaced by a sheet as it passes into the buckle chamber while urging the trail edge of the sheet against the outside of the foam roll. In a preferred embodiment each fingers is displacable by a force of 20 grams applied against the outer free end thereof.

By providing fingers in accordance with the present invention at the input nip, the sheet reversing apparatus is better able to handle different sizes and weights of paper having different physical conditions such as curl magnitude, folds, creases and surface friction.

Figure 2:
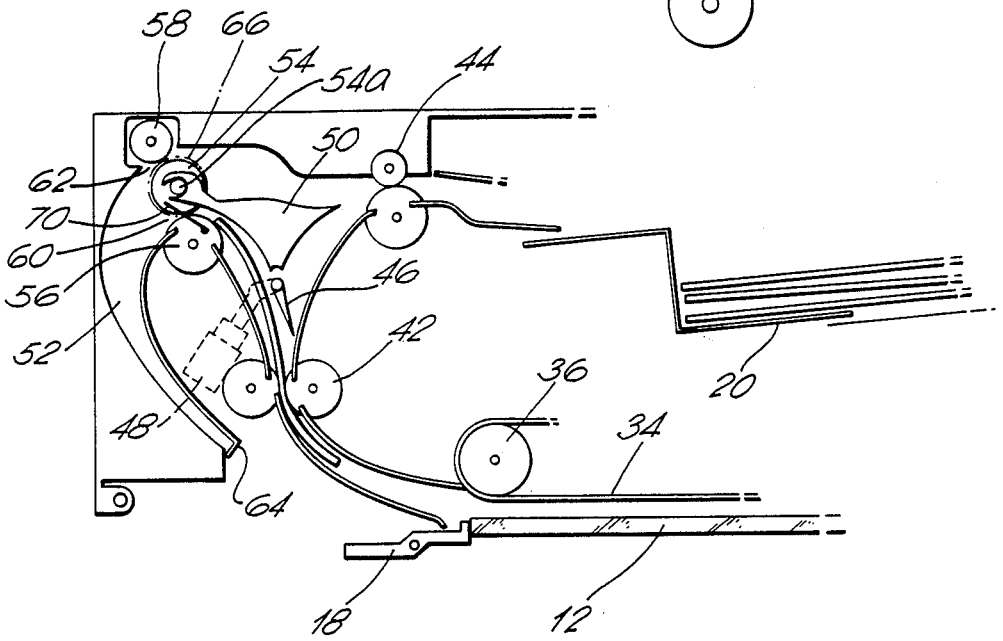
Figure 3:
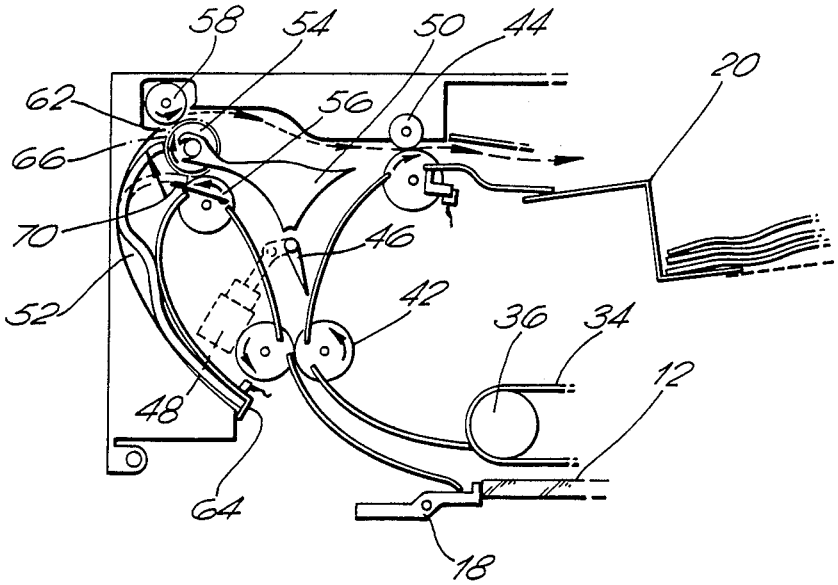
Figure 4:
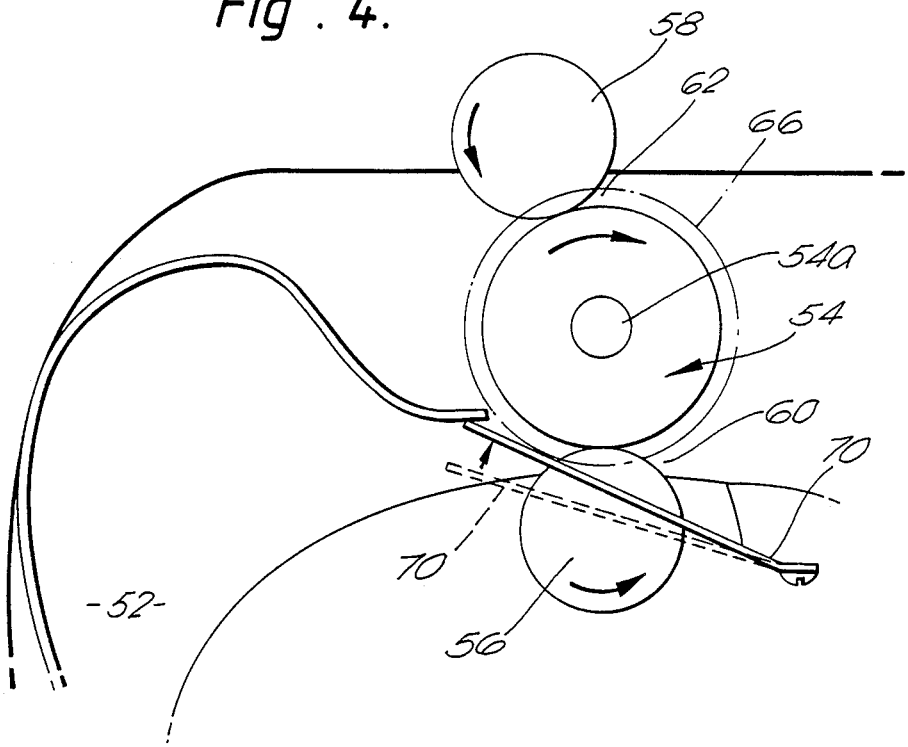
Figure 5:
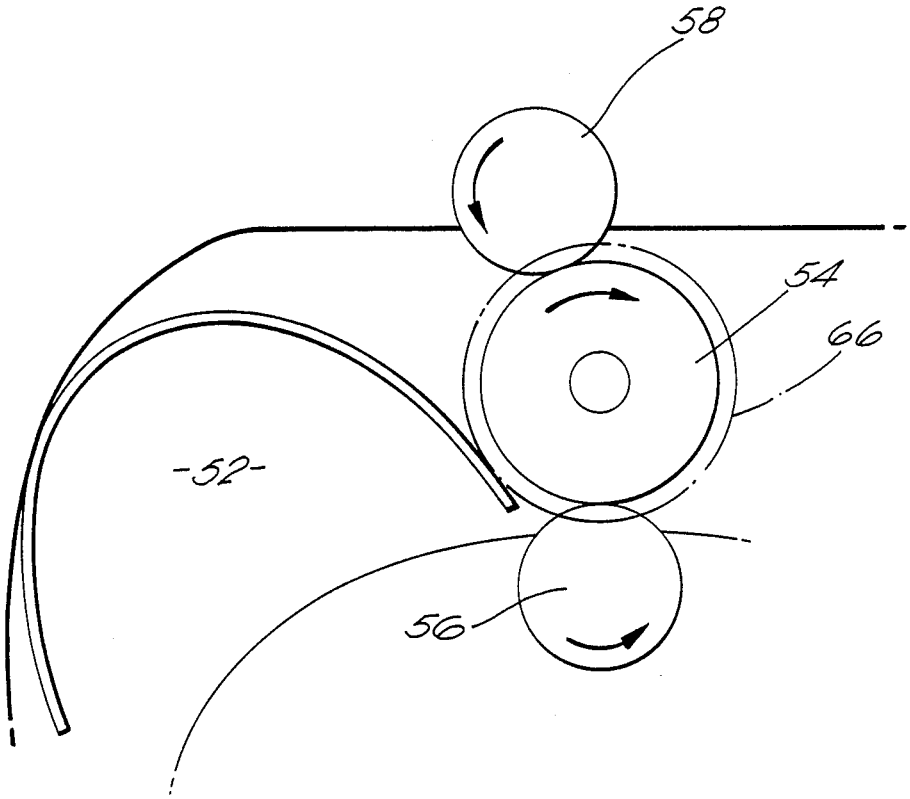

In order that the invention may be more readily understood reference will now be made to the accompanying drawings, in which:

FIG. 1 shows a recirculation document handler for a photocopier which incorporates a sheet reversing apparatus or inverter according to the present invention, FIG. 2 is an enlarged side elevation of the inverter showing a sheet about to enter the inverter, FIG. 3 is a view like that of FIG. 2 showing another stage in the operation of the inverter, FIG. 4 is a further enlarged view of the input end of the inverter showing the manner in which the trail edge of a sheet is engaged with the transfer means, and FIG. 5 is a view like that of FIG. 4 with the fingers of this invention omitted to illustrate how a sheet may fail to engage with the transfer means.

Referring now to FIG. 1 there is shown a recirculation document handler 10 arranged for feeding documents to be copied to the platen 12 of a photocopier 14. The document handler 10 includes a storage tray 20 for the documents to be copied and document circulating means for delivering the documents in turn to the platen 12 from the storage tray 20 and for returning the documents to the tray, whereby documents may be circulated and recirculated in sequence past the platen 12 for repeated copying (pre-collation mode). The documents may either be transported across the platen at a constant velocity past the optical system 16 of the photocopier which is held stationary in the solid line position shown, or instead they may be registered on the platen by a registration gate 18 prior to copying and the stationary document exposed by scanning the optical system 16 across the document. When the document is registered on the platen, the document handler can be operated in so-called stacks mode wherein each document is copied a plural number of times during a single delivery to the platen.

The document handler 10 comprises, in addition to the storage tray 20, a document seperator/feeder 22 a pre-platen transport 24 for conveying documents to the platen, a platen transport 26 and a post-platen transport 28 by which documents are returned to the storage tray.

The document storage tray 20 is mounted over the platen 12 and slopes upwardly towards the seperator/-feeder 22; it is adjustable to accommodate different document sizes.

Sheet seperation and acquisition is accomplished by a vacuum belt corrugation feeder (VCF) 22 using flotation pressure differences between the bottom sheet and the sheets above, sheet corrugation and vacuum, a parabolic contour pocket being cut out of the lead edge of the tray 20 and dished down in the manner shown and described in U.S. Pat. No. 4,275,877. Documents placed in the tray 20 bridge this gap and form a flotation pocket. Transport belts 30 surface through the document tray within the contour pocket. Document stack flotation is accomplished by a frontal assault of air from an air knife 32. The air jet impinges on the tray just in front of the lead edge of the document stack; this permits volumetric flow expansion of air within the pocket contour of the tray and also riffles the front edge of the documents to allow a differential pocket of air between the bottom sheet and sheet 2. This assists in the acquisition, seperation and feeding of the bottom document.

A set counter mechanism (not shown) is mounted at the back of the tray 20 and has a counter-arm projecting into the tray so that it can overlie the document(s) in the tray. The arm is pivoted so that as the last document is fed is it falls through a slot in the floor of the tray and actuates the sensor. The arm is then returned to the top of the document stack.

The pre-platen and post-platen transports 24, 28 consist of pairs of nip rolls and inner and outer inversion guides as shown and the platen transport 26 comprises a single white, wide friction drive belt 34 entrained over input and output transport rollers 36. The document is transported across the platen 12 by the belt 34. Three gravity rolls 38 apply a nip between the belt 34 and the platen 12 and maintain drive across the platen.

For inverting documents during circulation to make duplex-to duplex or duplex-to-simplex copies, a tri-roll inverter 40 is incorporated in the document handler in the post-platen transport 28. As shown in FIGS. 2 and 3 post-platen transport 28 includes a pair of intermediate nip rolls 42 and a pair of tray entry nip rolls 44. A diverter 46 operated by a solenoid 48 may be positioned either to direct documents through the normal simplex path direct to nip rolls 44, or to the inverter. A generally triangular guide 50 is provided above the diverter to guide sheets towards the nip rolls 44 or the invertor 40 as the case may be.

The tri-roll inverter 40 includes a curved buckle chamber 52 dimensioned to accommodate and buckle 8" to 8½" wide sheets (the sheets being fed long edge first). At the entrance to the buckle chamber 52 are arranged a common roller 54 engaged at opposite sides by a lower input roller 56 and an upper output roller 58 which respectively define input and output nips 60 and 62. Suitably, the common roller 54 is mounted on a drive shaft **54*a* and the rollers 56, 58 are idlers. The buckle chamber 52 is curved and its end opposite the rollers is closed by a stop 64 to limit the passage thereinto of the sheets so that they are buckled in the manner illustrated in FIG. 3. This combined with the curved shape of the buckle chamber, tends to urge the trail edge of the sheet into contact with foam rolls 66 mounted co-axially with and for rotation with the common roller 54, these foam rolls being of slightly larger diameter than the common roll and mounted on the common roll shaft 54*a*. With this arrangement once the trail edge of the sheet engages the surface of the foam roll it will be carried or transferred from the input nip 60 to the output nip 62** and driven out of the buckle chamber with its lead to trail edge orientation reversed.

However, sheets which lack sufficient beam strength due for example to their light weight or because they are in curled condition or have suffered operator folding or other damage, may be buckled prematurely as shown in FIG. 5. Another cause of this condition can be excessive static or surface friction on the paper surface which resists paper movement to the end stop 64 and causes premature buckling for this reason. In either case it will be seen from FIG. 5 that the trail edge of the paper is at the wrong approach angle to be influenced by the foam rolls and the sheet will become jammed in the buckle chamber 52. In order to avoid this condition occurring inversion assistance fingers 70 in accordance with the present invention are provided as shown in FIG. 4. As seen in FIG. 4, the fingers 70 are positioned in the lower or input nip region 60 and work in conjunction with the foam rolls 66. The fingers are arranged axially between the foam rolls and nip rolls 54, 56 and are arranged and dimensioned so as to engage the trail end of a sheet passing through the input nip and urge the sheet trail edge into contact with the foam rolls 66 as shown in FIG. 4. To this end the fingers 70 are anchored upstream of the nip and project downstream to the other side of the nip. The fingers are resilient and in the absence of a sheet either press upwardly against the centre drive shaft **54*a* or are close to the shaft in their free state. They are sufficiently flexible to be deflected by a sheet passing through the nip 60 to the position shown in broken lines in FIG. 4 yet sufficiently resilient to press the sheet trail edge into contact with the foam rolls 66 as shown in full lines in FIG. 4. The fingers are sufficiently long that in the full-line condition shown in FIG. 4 they project, when seen in side elevation, tangentially beyond the surfaces of the foam rolls. Thus in an embodiment in which the foam rolls are 22 mm in diameter the fingers project beyond the notional tangential point (indicated at 74 in FIG. 4**) on the foam roll surface by 2.5 mm.

The angle of the fingers to the common tangent through the nip 60 in their free or shaft engaging condition is suitably between 20° and 50° with a preferred angle being 45° in which case when engaging the sheet trail edge they adopt an angle of about 30°.

As mentioned above the fingers 70 are resilient, being made for example of a resilient plastics material such as Mylar, so as to facilitate the passage of sheets through the nip as they enter the buckle chamber 52 while providing the necessary urging force against the sheet trail end and in a preferred embodiment the fingers may be deflected by a force of 20 grams applied downwardly against the free ends thereof.

It has been mentioned above that the fingers are axially spaced along the nip 60 with respect to the foam rolls. In a preferred embodiment there are two spaced nip roller groups and each drive roller 54 is flanked by a pair of foam rolls 66. Two fingers 70 are spaced apart between the centre foam rolls.

In operation as a sheet enters the buckle chamber 5 through the lower nip 60 the fingers 70 are deflected downwardly by the sheet. When the trail edge of the sheet is at a point where it just leaves the lower nip, the paper is now in a free state and the fingers 70 press upwardly against the trail end of the sheet thus lifting its trail edge into the influence of the foam rolls 66 regardless of the approach angle of the paper with respect to the foam rolls. The trail edge of the sheet is then induced by the foam rolls 66 in the normal manner into the upper nip 62 to be transported out of the buckle chamber.

It will be realized from the foregoing that an inverter according to the present invention is better able to handle a wide range of sheet conditions compared with prior art devices, particularly with regard to size and weight and in respect of the physical condition of the paper such as curl magnitude, folds, creases and surface friction.

While a specific embodiment of the invention has been described it will be understood that various changes may be made to the specific details referred to herein without departing from the scope of the invention as defined in the appended claims. For example while the inverter of this invention has been described in relation to the invertion of sheets in a document handler it may equally be used for inverting or reversing copy sheets in a photocopier.

While the inversion assistance fingers described in the specific embodiment above are resilient it will be understood that rigid fingers which may be fixed or spring loaded may be used instead.

Although an embodiment is described in which the input nip is below the output nip it will be understood that their position may be reversed in which case the trail edge of the sheet is transferred downwardly around the foam rolls. Equally, other orientation of the inverter are possible and it may for example be vertical with the sheets entering the buckle chamber either at the top or the bottom.

What is claimed is:

1. Sheet reversing apparatus including a buckle chamber and sheet feed means for feeding a sheet into and out of one end of said buckle chamber against an end stop to reverse the lead and trail edge orientation of the sheet, said sheet feed means comprising lower input and upper output rollers which cooperate with a common roller respectively to form input and output nips for conveying sheets into and to of the buckle chamber, and at least one finger arranged to engage the trail edge of the sheet immediately after it exits said input nip and lift the trail end of the sheet while guiding it into contact with said common roller and maintaining the contact of the sheet with said common roller for a period of time causing said common roller to transport the trail end of the sheet into said output nip.

2. Sheet reversing apparatus including a buckle chamber and sheet feed means for feeding a sheet into and out of one end of said buckle chamber against an end stop to reverse the lead and trail edge orientation of the sheet, said sheet feed means comprising input and output rollers which cooperate with a common roller respectively to form lower input and upper output nips for conveying sheets into and out of the buckle chamber, and transfer means co-axial with said common roller for engaging the sheet trail edge and transferring it from said input nip to said output nip, characterised by at least one finger arranged to engage the trail edge of the sheet as it passes through said input nip and urge said trail edge into contact with said transfer means by lifting the trail edge of the sheet.

3. Sheet reversing apparatus according to claim 2, in which the or each finger extends from a mounting point upstream of said input nip and terminates downstream of the nip in order to insure that by lifting the trail edge of the sheet a sheet that is curled, damaged or has low beam strength said trail edge of the sheet will be directed into said transfer means at a proper angle for transport to said output nip.

4. Sheet reversing apparatus according to claim 2, in which the transfer means comprises at least one foam roll mounted co-axially with and adjacent to said common roller for rotation therewith.

5. Sheet reversing apparatus according to claim 4, in which said at least one finger is resilient and may adopt a position extending downstream of the input nip along a tangential line relative to the at least one foam roll and which intercepts the common tangent to the input and common rollers through the input nip, from a position inward of the outer circumference of the input roller to a position beyond the tangential point on the foam roll.

6. Sheet reversing apparatus according to claim 5, in which in said position the angle of the or each finger to said common tangent is 5° to 35°.

* * * * *